United States Patent [19]

Herrmann et al.

[11] 3,967,632

[45] July 6, 1976

[54] ARRANGEMENT FOR THE FLUID TREATMENT, ESPECIALLY ETCHING, OF OBJECTS IN ASSEMBLY-LINE-LIKE FASHION

[75] Inventors: Günther Herrmann, Furth; Adam Pill, Auenwald-Mittelbruden, both of Germany

[73] Assignee: Adam Pill, Auenwald-Mittelbruden, Germany

[22] Filed: June 17, 1974

[21] Appl. No.: 479,994

[30] Foreign Application Priority Data

June 27, 1973 Germany ..... 2332547

[52] U.S. Cl. ..... 134/83; 134/113; 134/154; 156/345

[51] Int. Cl.[2] ..... B08B 3/02

[58] Field of Search ..... 134/82, 83, 113, 72, 134/131, 154, 155, 165, 182, 183; 156/345

[56] References Cited

UNITED STATES PATENTS

| | | | |
|---|---|---|---|
| 1,406,465 | 2/1922 | Lynch | 134/113 X |
| 1,737,938 | 12/1929 | Miller | 134/82 X |
| 2,621,673 | 12/1952 | Hodgens, Jr. | 134/113 X |
| 3,266,502 | 8/1966 | Copeland | 134/82 X |
| 3,401,068 | 9/1968 | Benton | 134/82 X |
| 3,426,773 | 2/1969 | Yatuni | 134/165 X |

FOREIGN PATENTS OR APPLICATIONS

| | | | |
|---|---|---|---|
| 105,270 | 12/1964 | Norway | 134/113 |

OTHER PUBLICATIONS

Greene et al., "Photocell Controlled Etcher" IBM Tech. Disclosure Bulletin, Oct. 5, 1967, pp. 582–584.

*Primary Examiner*—Robert L. Bleutge
*Attorney, Agent, or Firm*—Michael J. Striker

[57] ABSTRACT

The arrangement includes a treatment fluid supply chamber, a first treatment chamber located above the treatment fluid supply chamber, and at least one additional treatment chamber located above the first treatment chamber. Objects are conveyed along a first predetermined path leading through the first treatment chamber and also along a second predetermined path leading through the additional treatment chamber. Treatment fluid is pumped up from the common treatment fluid supply chamber to both of said treatment chambers, and the thusly pumped fluid is discharged onto objects in both treatment chambers.

14 Claims, 3 Drawing Figures

ARRANGEMENT FOR THE FLUID TREATMENT, ESPECIALLY ETCHING, OF OBJECTS IN ASSEMBLY-LINE-LIKE FASHION

BACKGROUND OF THE INVENTION

The invention relates to an arrangement for the fluid treatment, especially etching, of objects, such as printed circuits, mold sections, and the like, in assembly-line-like fashion. The objects to be treated pass through successively arranged treatment chambers. At least one of these treatment chambers is a fluid treatment chamber supplied with treatment fluid from a supply tank by means of a pump, with the treatment fluid being sprayed, sprinkled or in other manner discharged onto the objects passing through the fluid treatment chamber.

Known fluid treatment apparatuses of this type are extremely space-consuming. The paths along which the objects to be treated are conveyed may be as long as 20 meters.

SUMMARY OF THE INVENTION

It is a general object of the invention to provide a fluid treatment apparatus of the general type in question which, however, because of its basic design, is inherently less space-consuming.

This object, and others which will become more understandable from the description, below, of specific embodiments, can be met, according to one advantageous concept of the invention, by providing an arrangement for the fluid treatment, particularly etching, of objects, particularly printed circuits, mold sections, and the like, in assembly-line-like fashion, comprising, in combination, a treatment fluid supply chamber, a first treatment chamber located above the treatment fluid supply chamber, and at least one additional treatment chamber located above the first treatment chamber. Conveyor means conveys objects along a first path leading through the first treatment chamber and along a second path leading through the additional treatment chamber. Treatment fluid pumping and emitting means is operative for pumping treatment fluid up from the treatment fluid supply chamber and for discharging the thusly pumped treatment fluid onto objects in both the first and the additional treatment chambers.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
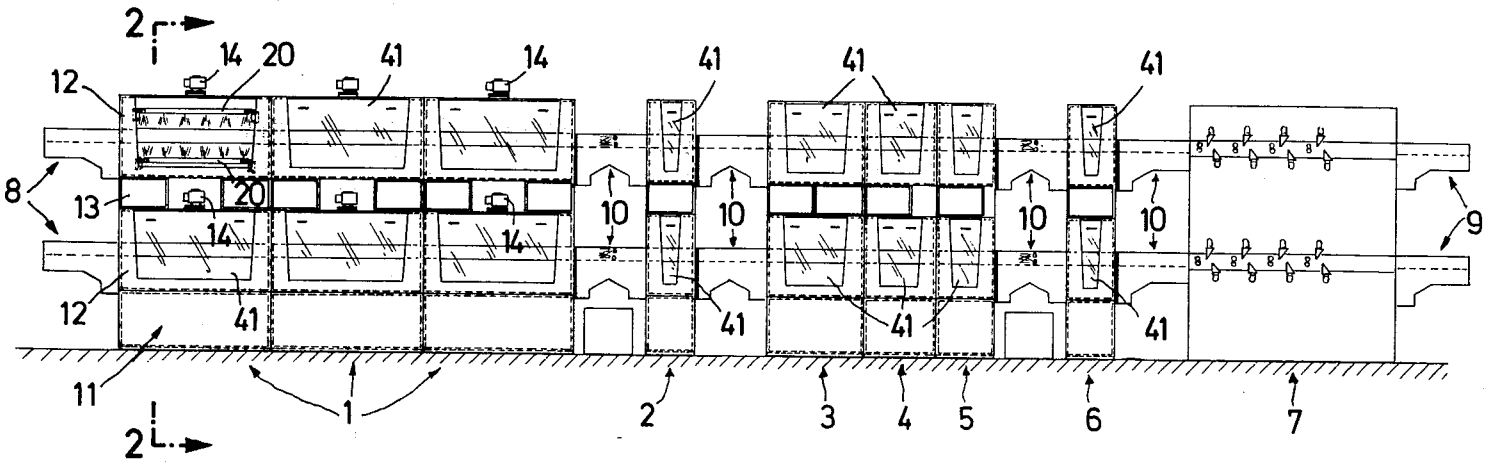
FIG. 1 is a schematic side view of a two-tiered etching apparatus.

There are depicted in FIG. 1 a plurality of treatment units, arranged in two substantially identical tiers, one atop the other, through which pass respective first and second successions of objects. The illustrated apparatus may for example be employed for etching objects such as printed circuits, mold sections, and the like.

The three first units are comprised of successive etching chambers 1 in which fluid etching medium is sprayed onto both sides of objects located in the etching chambers. Following upon the etching units 1 are two rinsing chambers 2, one stacked above the other, two color washoff chambers 3, two deoxidation chambers 5, two further rinsing chambers 6, and a drying chamber 7. The chambers of each of the two tiers are connected together by conveying devices, for example belt or roller conveyors. The first superimposed pair of etching chambers 1 is provided with infeed arrangements 8. The drying chamber 7 is provided with two outfeed arrangements 9. Successive portions of the series of stacked treatment chambers are separated from each other by intermediate spaces which are bridged by respective intermediate conveyor devices 10 of any suitable kind. The objects to be subjected to the fluid treatment are conveyed from the respective one of the infeed arrangements 8 through the respective tier of treating chambers and emerge at the respective one of the outfeed arrangements 9 in finished condition. The chambers 1 to 6 are fluid treatment chambers, whereas in the drying chamber 7 the treated objects are warmed by means of warm air, heating radiation or the like.

Figure 2:
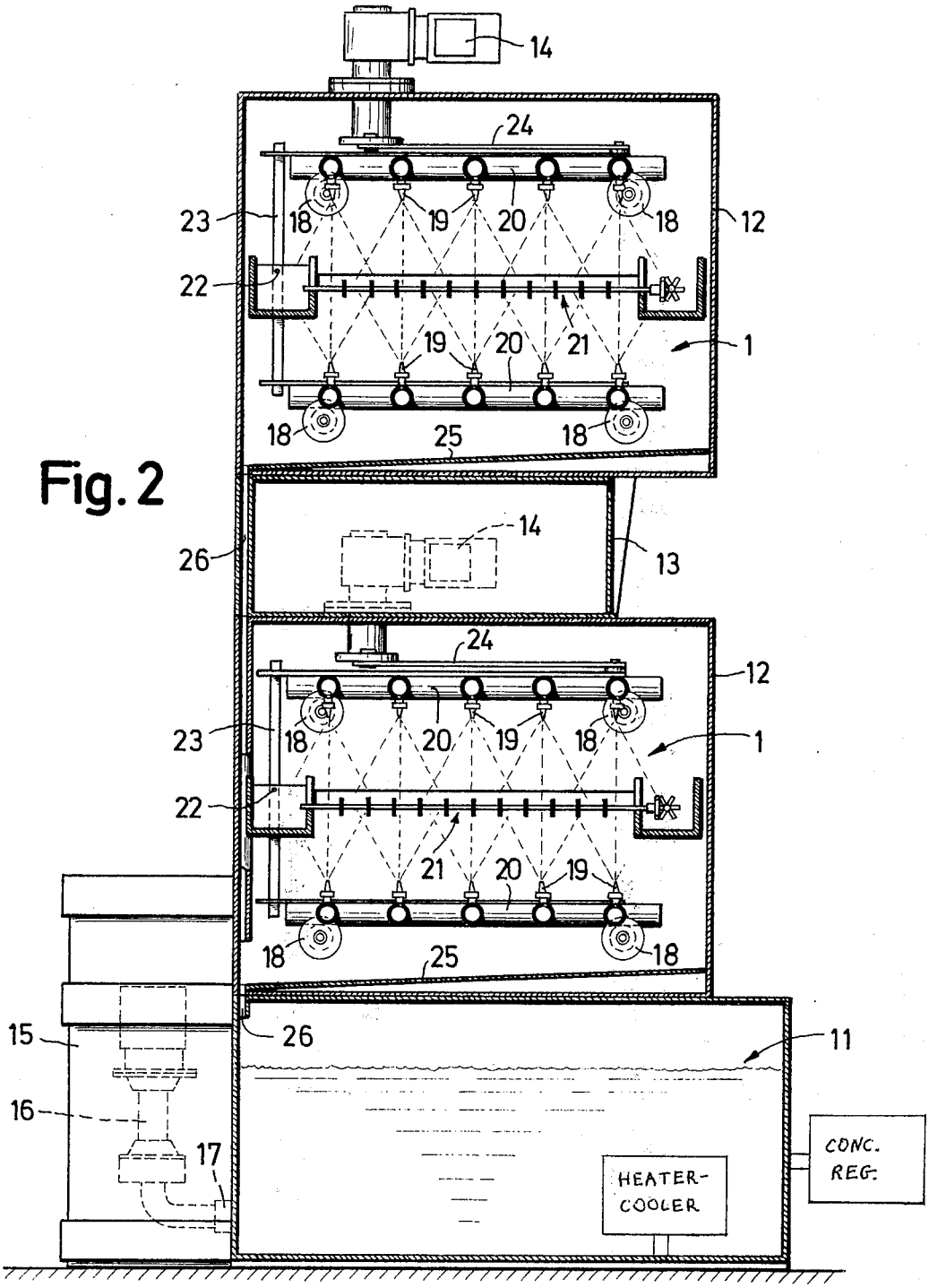
FIG. 2 is a sectional view taken on line 2-2 of FIG. 1.

FIG. 2 is a section, on an enlarged scale, through the apparatus shown in FIG. 1. Mounted above a common treatment fluid supply chamber 11, in this embodiment having the form of a closed tank, there is provided a first housing 12 defining a first treatment chamber, for example an etching chamber 1. Above the lower housing 12 there is mounted a box-shaped housing 13 in which there is provided an electromotor 14 as well as additional (non-illustrated) electrical circuit elements, such as switches, relays, safety devices, and the like, employed for example when the apparatus is in automatic operation. Mounted above the housing 13 is an additional housing 12 defining an additional treatment chamber, likewise an etching chamber. The additional etching chamber 1 is provided with a respective electromotor 14 mounted thereabove. To the left side of the illustrated apparatus there is provided a housing 15 which contains a pump 16, the suction port 17 of which communicates with the interior of the treatment fluid supply chamber 11.

In the first and additional treatment chambers 1, there are provided spray frames 20 mounted on rollers 18 and provided with a plurality of fluid discharge members 19, here in the form of spray nozzles arranged both above and below the object to be sprayed in the respective etching chamber. The object is conveyed through the respective etching chamber by means of a respective roller conveyor 21. The two lattice-shaped spray frames 20 in each of the etching chambers 1 are connected together by means of a lever 23 which is pivotable at 22. In each etching chamber, the upper spray frame 20 is connected to a crank disk mounted on the output shaft of the respective electromotor 14 by means of a rod 24. When the output shaft of the respective electromotor 14 rotates, the respective crank disk and rod 24 convert the rotational motion of the motor output shaft into a longitudinal reciprocation of the upper spray frame 20. The respective lower spray frame 20 is connected to the upper frame 20 by the pivotable lever 23, and accordingly likewise reciprocates, but always in the opposite longitudinal directions. Consequently, the treatment fluid being discharged from the nozzles 19 is discharged evenly over the whole width of the object supported on the respective roller conveyor 21. The pressure or outlet port of the pump 16 is connected to the several spray frames 20 and thereby to the nozzles 19 by means of non-illustrated partially flexible conduits.

The excess etching fluid dripping down off the etched objects in the chambers 1 runs down a respective inclined bottom wall 25 of the etching chamber and then down through a runoff conduit 26 back into the treatment fluid supply chamber 11, to be pumped up again by the pump 16 and again discharged from the nozzles 19 of the spray frames 20.

The inventive construction of FIG. 2 is characterized by two important advantages. Firstly, the arrangement of two etching chambers one atop the other greatly reduces the space requirement for the entire apparatus, since the breadth and length of the etching arrangement is not increased by providing two such etching chambers instead of only one. This is of considerable significance in placing the entire apparatus in an industrial plant, because in such plants floor space is generally at a premium, whereas overhead space is generally fairly abundant, so that a height increase of the entire apparatus will usually present no problem.

Secondly, the inventive manner of stacking the treatment chambers 1 results in reduced space consumption for another reason, also. By stacking the treatment chambers 1 one above another, each such stack of treatment chambers 1 can be supplied by a single common treatment fluid supply chamber 11. Thus, the spray frames 20 in two treatment chambers 1 can be supplied by means of a single pump 16 from a single shared fluid supply chamber 11. In FIG. 2, two treatment chambers 1 are shown stacked. However, it is also possible to place atop the upper treatment chamber 1 open or more further treatment chambers, and to supply all of the treatment chambers in such a stack from the single respective treatment fluid supply chamber 11. The width and breadth of the arrangement evidently will not increase.

Figure 3:
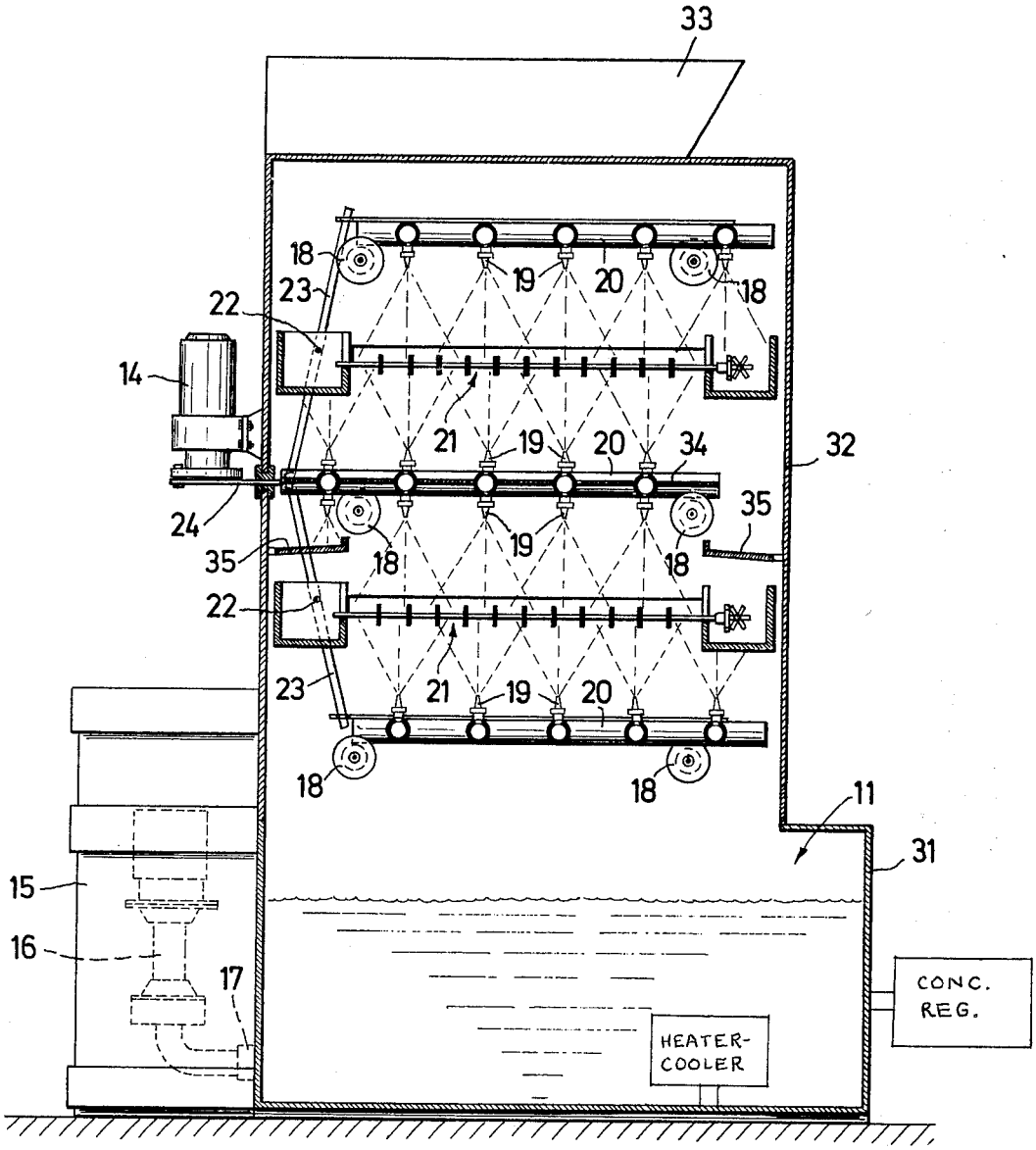
FIG. 3 is a sectional view similar to FIG. 2 but of another embodiment of the invention.

FIG. 3 depicts an embodiment somewhat simpler than that of FIG. 2. Parts in FIG. 3 which correspond to parts in FIG. 2 are designated by the same reference numerals as employed in FIG. 2. In FIG. 3 the treatment fluid supply tank 11 is not provided in the form of a closed tank, but instead has the form of an open vat or tub 31. Mounted atop this tub 31 is a common housing 32 which accommodates the roller conveyors 21 and the associated spray frames 20 of the two tiers. The housing 32 does not contain an intermediate wall and at the bottom opens in downwards direction into the top of the vat 31. The drive motor 14 which reciprocates the spray frames 20 is provided atop the housing 32 contains the electricl control circuitry for the arrangement. Inherently, the construction of FIG. 3 will be of lesser total height than the construction of FIG. 2.

In FIG. 3, as in FIG. 2, the pressure port or outlet of pump 16 is connected to the individual spray frames 20 by means of non-illustrated in part flexible conduits. The middle spray frame 20 of FIG. 3 is connected by means of a shaft 24 to a crank disk mounted on the output shaft of the motor 14. When the motor output shaft rotates, the middle spray frame 20 is longitudinally reciprocated in left-right direction, rolling on the rollers 18. The upper and lower spray frames 20 are connected to the middle spray frame 20 by means of levers 23 pivotable at 22, and accordingly reciprocate simultaneously with the middle frame 20, but always in direction opposite to the middle frame 20. The middle spray frame 20 is provided with nozzles 19 directed in both upwards and downwards direction. The upwardly directed nozzles spray the lower side of the object which is being transported through the upper treatment chamber on the upper roller conveyor 21; the downwardly directed nozzles spray the upper side of the object which is being transported through the lower treatment chamber on the lower roller conveyor 21. As shown, the middle, lattice-like spray frame 20, constructed of hollow pipes, is provided with a closed bottom 34 which extends over the entire length and breadth of the middle spray frame 20. The bottom wall 34 prevents treatment fluid discharged from the upper nozzles 19, and also treatment fluid dripping down from the object in the upper treatment chamber, from dripping down onto the object in the lower treatment chamber. The treatment fluid accumulating on the bottom wall 34 runs off into a runoff channel 35 and from there returns into the treatment fluid supply chamber 11.

The construction shown in FIG. 3 has the same advantages as that shown in FIG. 2. Additionally, the construction shown in FIG. 3 is simpler to construct than that of FIG. 2.

Advantageously, the treatment fluid supply chambers 11 are provided with per se known regulating and dosing arrangements, provided for example in the housing 15. In particular, these arrangements serve to maintain constant the concentration of etching medium in the etching fluid.

It is also possible to transport the objects through the first tier of chambers at one speed and to transport the objects through the second tier of chambers at a different speed. For example, this might be desired in order to etch to different degrees the objects in the two different tiers. In such case, separate drive means must be provided for the conveyors of each tier, for example separate drive motors or transmission gearing.

When the upper and lower conveyors are driven at the same speed, then a single drive arrangement is sufficient. In the treatment fluid supply chamber 11 there can be provided, if necessary, per se known temperature control means for heating and/or cooling the treatment fluid. Since the two stacked treatment chambers are supplied from a single common treatment fluid supply chamber 11, the cooling and heating devices for such fluid can likewise be shared, resulting in a further reduction in cost and material.

In the set-up shown in FIG. 1, the individual treatment chambers, or more properly stacks of treatment chambers, are arranged in succession, in a straight line. However, it is also possible, for example by suitable design of the intermediate conveyors 10, to cause the objects to be etched to travel through the successive treatment chambers along an angled path, which may result in the saving of considerable space in certain circumstances.

As particularly clear from FIGS. 1 ad 2, the inventive arrangement can advantageously be comprised of individual structual units or modules, enclosed for example by the respective housings 12, 13, 15, 32, 33. This results in the possibility of adapting the apparatus to a great variety of uses and locations, and makes expansion and/or modification of an existing set-up relatively easy. For example, the arrangement can initially be constructed as a single-tier arrangement and then, when the need arises, can be added to, to form an arrangement having two or more tiers.

As can be seen in FIG. 1, the side walls of the chambers 1 to 7 are provided with windows 41 which permit observation of the treatment being performed upon an object located in the respective one of the treatment chambers. These windows 41 are formed of transparent plates, advantageously plastic, and are designed in the form of sliding windows. As shown, the windows 41 are of trapezoidal shape. Moreover, they open by being slid in upwards direction. An advantageous result of such configuration is that, if one of the sliding windows 41 jams in its mounting and guide frame, for example as a result of the action of the etching medium, freeing of the jammed window is facilitated. Specifically, lifting up of the jammed window to an extent releasing it slightly from its frame makes possible complete removal of the window from the window frame, on account of the trapezoidal shape of both. Moreover, by removing one of the sliding windows 41, access is gained to the interior of the respective treatment chamber, so that the interior of each treatment chamber can be separately inspected, cleaned, or the equipment therein repaired or adjusted, independently of the other treatment chambers. The use of trapezoidally shaped window panes 41 in correspondingly configurated sliding-groove window frames is not limited to etching apparatuses such as shown here.

According to the invention, objects can be subjected to fluid treatment in the plurality of tiers simultaneously or alternatively. In different ones of the tiers, workpieces can be etched or worked to different respective depths. The saving in space, compared to conventional constructions, amounts to about 50%. This is of particular significance, because it results in a reduction in the amount of work space which must be made resistant, usually in a costly manner, to the effects of the etching medium, or other treatment fluid. Additionally, the arrangement according to the invention is easier and simpler to monitor, since the supply, dosing and regulation of the treatment fluid is performed in a more centralized manner than in the prior art.

It will be understood that each of the elements described above, or two or more together, may also find a useful application in other types of constructions differing from the types described above.

While the invention has been illustrated and described as embodied in an apparatus for etching printed circuits, mold sections, and the like, it is not intended to be limited to the details shown, since various modifications and structural changes may be made without departing in any way from the spirit of the present invention.

Without further analysis, the foregoing will so fully reveal the gist of the present invention that others can be applying current knowledge readily adapt it for various applications without omitting features that, from the standpoint of prior art, fairly constitute essential characteristics of the generic or specific aspects of this invention and, therefore such adaptations should and are intended to be comprehended within the meaning and range of equivalence of the following claims.

What is claimed as new and desired to be protected by Letters Patent is set forth in the appended

1. An arrangement for the fluid treatment, particularly etching, of objects, particularly printed circuits, mold sections, and the like, in assembly-line-like fashion, comprising, in combination, a closed treatment fluid supply chamber; a first treatment chamber located above said treatment fluid supply chamber; at least one additional treatment chamber located above said first treatment chamber, said treatment chambers being separated from each other by separating walls, each of said treatment chambers having a side wall; an intermediate chamber between said treatment chambers and partly bounded by said separating walls, said intermediate chamber spacing said treatment chambers from one another; conveyor means for conveying objects along a first predetermined path leading through said first treatment chamber at a first speed, and along a second predetermined path leading through said additional treatment chamber at a second speed; treatment fluid pumping and emitting means operative for pumping treatment fluid up from said treatment fluid supply chamber and for discharging the thusly pumped treatment fluid onto objects in both said first and said additional treatment chambers; control equipment in said intermediate chamber for controlling the operation of the arrangement; and at least one observation and access window of trapezoidal shape mounted in each respective side wall for sliding with respect thereto in a predetermined direction between a closed and an open position and having marginal portions diverging in said direction and engaging said side wall when said window is in said closed position thereof, whereas a slight movement of said window in said direction dissociates said marginal portions from said side wall so that movement of said window towards said open position is facilitated even when said window is jammed in said side wall.

2. An arrangement as defined in claim 1, and further including means for regulating the concentration of treatment fluid in said treatment fluid supply chamber.

3. An arrangement as defined in claim 1, wherein said treatment chambers and said treatment fluid supply chamber are all substantially in open communication with each other.

4. An arrangement as defined in claim 1, wherein said first speed is different from said second speed.

5. An arrangement as defined in claim 1, and further including heating means for heating the fluid in said treatment fluid supply tank.

6. An arrangement as defined in claim 1, and further including cooling means for cooling the fluid in said treatment fluid supply tank.

7. An arrangement as defined in claim 1, wherein said conveyor means is comprised of a single drive motor.

8. An arrangement as defined in claim 1, wherein said conveyor means is comprised of a first drive motor for the conveying of objects along said first path and a second drive motor for the conveying of objects along said second path.

9. An arrangement as defined in claim 1, wherein said treatment fluid pumping and emitting means is comprised of at least one fluid discharge member in at least one of said treatment chambers, and wherein said fluid discharge member is mounted for reciprocating movement in the respective treatment chamber, and further including a motor in said intermediate chamber connected to said fluid discharge member and operative for reciprocating said fluid discharge member.

10. An arrangement as defined in claim 1, wherein said arrangement is comprised of a plurality of treatment fluid supply chambers arranged in succession, a plurality of first treatment chambers each located above a respective one of said treatment fluid supply chambers, a plurality of additional treatment chambers each located above a respective one of said first treatment chambers, and a plurality of treatment fluid pumping and emitting means each operative for pumping treatment fluid up from a respective one of said treatment fluid supply chambers and for discharging the thusly pumped treatment fluid onto objects in the respective ones of said first and additional treatment chambers, and wherein said first path leads through successive ones of said first chambers and wherein said second path leads through successive ones of said additional chambers.

11. An arrangement as defined in claim 10, wherein said paths are both elongated straight paths.

12. An arrangement as defined in claim 10, wherein said paths are angled paths.

13. An arrangement as defined in claim 10, wherein each of said treatment chambers has a side wall provided with a trapezoidal sliding observation window.

14. An arrangement as defined in claim 1, wherein said treatment chambers are enclosed in a common housing and in communication with each other but partially separated from each other by said separating walls.

* * * * *